US008115719B2

(12) United States Patent
Fujita

(10) Patent No.: US 8,115,719 B2
(45) Date of Patent: Feb. 14, 2012

(54) ELECTRO-OPTICAL DEVICE

(75) Inventor: Shin Fujita, Suwa (JP)
(73) Assignee: Sony Corporation, Tokyo (JP)

( * ) Notice: Subject to any disclaimer, the term of this patent is extended or adjusted under 35 U.S.C. 154(b) by 475 days.

(21) Appl. No.: 12/428,909

(22) Filed: Apr. 23, 2009

(65) Prior Publication Data

US 2009/0273554 A1 Nov. 5, 2009

(30) Foreign Application Priority Data

May 1, 2008 (JP) ..... 2008-119953

(51) Int. Cl.
*G09G 3/36* (2006.01)

(52) U.S. Cl. ..... 345/96; 345/209; 349/37

(58) Field of Classification Search ..... 345/37, 345/91, 94, 96, 98, 209; 349/37, 41
See application file for complete search history.

(56) References Cited

U.S. PATENT DOCUMENTS 7,629,953 B2 * 12/2009 Fukui ..... 345/89

FOREIGN PATENT DOCUMENTS

JP A-2002-196358 7/2002
JP A-2006-313319 11/2006

* cited by examiner

*Primary Examiner* — Abbas Abdulselam
(74) *Attorney, Agent, or Firm* — K&L Gates LLP

(57) ABSTRACT

Provided is an electro-optical device including: pixel electrodes provided in intersections of gate lines and data lines; counter electrodes provided to face the pixel electrodes with an electro-optical material interposed therebetween; and storage capacitors each of which one end is connected to each of the pixel electrodes, wherein, if data line signals supplied to the pixel electrodes via the data lines correspond to writing of a positive polarity with respect to the potential of the counter electrodes, the potential of the other end of each of the storage capacitors is changed to a high potential side after the data line signals are written and, if the data line signals correspond to writing of a negative polarity with respect to the potential of the counter electrodes, the potential of the other end of each of the storage capacitors is held at a constant level before and after the data line signals are written.

10 Claims, 11 Drawing Sheets

NORMALLY-BLACK WHITE DISPLAY
(POSITIVE POLARITY)

NORMALLY-BLACK BLACK DISPLAY
(POSITIVE POLARITY)

NORMALLY-BLACK WHITE DISPLAY
(NEGATIVE POLARITY)

NORMALLY-BLACK BLACK DISPLAY
(NEGATIVE POLARITY)

ELECTRO-OPTICAL DEVICE

BACKGROUND

1. Technical Field

The present invention relates to an electro-optical device and, more particularly, an electro-optical device including a pixel electrode and a counter electrode facing the pixel electrode, such as a liquid crystal display device.

2. Related Art

In the related art, a display device including a pixel electrode and a counter electrode facing the pixel electrode is known (for example, see JP-A-2002-196358).

In JP-A-2002-196358, a liquid crystal display device including the pixel and counter electrodes which face each other with liquid crystal interposed therebetween and a storage capacitance (storage capacitor) for holding the potential of the pixel electrode is disclosed. In the liquid crystal display device described in JP-A-2002-196358, if a written video signal has a high potential, the potential of the storage capacitance is changed to the high potential side after the video signal is written and, if the written video signal has a low potential, the potential of the storage capacitance is changed to the low potential side after the video signal is written.

However, in the liquid crystal display device described in JP-A-2002-196358, if the above-described operation is performed, the potential of the pixel electrode is changed to the high potential side and the low potential side by changing the potential of the storage capacitor, and the amplitude of the potential of the pixel electrode is increased by the change to the high potential side and the low potential side. Accordingly, since the amplitude of a gate signal for controlling ON/OFF of the writing of the video signal to the pixel electrode should be also increased, it is difficult to reduce power consumption.

SUMMARY

An advantage of some aspects of the invention is that it provides an electro-optical device capable of reducing power consumption.

According to a first aspect of the invention, there is provided an electro-optical device including: pixel electrodes provided in intersections of gate lines and data lines; counter electrodes provided to face the pixel electrodes with an electro-optical material interposed therebetween; and storage capacitors each of which one end is connected to each of the pixel electrodes, wherein, if data line signals supplied to the pixel electrodes via the data lines correspond to writing of a positive polarity with respect to the potential of the counter electrodes, the potential of the other end of each of the storage capacitors is changed to a high potential side after the data line signals are written and, if the data line signals correspond to writing of a negative polarity with respect to the potential of the counter electrodes, the potential of the other end of each of the storage capacitors is held at a constant level before and after the data line signals are written.

In the electro-optical device according to the first aspect of the invention, as described above, if the data line signals written to the pixel electrodes correspond to writing of a negative polarity (low potential side) with respect to the potential of the counter electrodes, the writing of the data line signals are controlled to be performed in a state in which the potential of the storage capacitors is held at a constant level, unlike the case where the written data line signals correspond to writing of a positive polarity (high potential side) with respect to the potential of the counter electrodes. That is, since the potential of the pixel electrodes is not changed to the low potential side after the writing of the data line signals to the pixel electrodes, it is possible to decrease the amplitude of the change in potential of the pixel electrodes. Accordingly, it is possible to decrease the amplitude of the signals (gate signals) for controlling the ON/OFF of the writing of the data line signals to the pixel electrodes. Therefore, it is possible to decrease power consumption at the time of writing the data line signals to the pixel electrodes by decreasing the amplitude of the gate signals.

The electro-optical device according to the first aspect may further include pixel transistors connected to the pixel electrodes; gate lines which supply gate signals for controlling ON/OFF of the pixel transistors; a gate line scanning unit which scans the gate lines; and a driving power source which supplies a driving power source potential to the gate line scanning unit, and an OFF potential of the gate signals supplied to the pixel transistors may become a reference potential of the electro-optical device. By this configuration, since the ON potential and the OFF potential (reference potential) of the gate signals are controlled at only the high potential side (positive polarity side) with reference to the reference potential, it is possible to drive the gate lines without separately providing a power source at the side of the negative polarity with respect to the reference potential. Accordingly, it is possible to suppress the increase in the number of power sources.

In this case, electro-optical device may further include capacitive lines connected to the storage capacitors; and capacitive line control circuits which control the potentials of the storage capacitors via the capacitive lines, wherein the capacitive line control circuits are connected to the gate lines, and control the potentials of the storage capacitors on the basis of the gate signals supplied from the gate lines. By this configuration, since the potential of the storage capacitors can be controlled without separately generating the signal for controlling the potential of the storage capacitors, it is possible to suppress complication of the circuit.

In the electro-optical device including the capacitive lines and the capacitive line control circuits, the capacitive line control circuits may be provided in the capacitive lines, respectively, a plurality of pixels having the pixel transistors, and a dummy gate line connected to the capacitive line control circuit arranged in correspondence with the capacitive line of a first stage may be further included, and a signal for controlling the potential of the storage capacitors corresponding to the capacitive line of the first stage may be supplied from the capacitive line control circuit arranged in correspondence with the capacitive line of the first stage to the capacitive line of the first stage, on the basis of a dummy gate signal supplied by the dummy gate line. By this configuration, it is possible to easily control the potential of the storage capacitors corresponding to the capacitive line of the first stage on the basis of the dummy gate signal.

In the configuration including the plurality of pixels, the plurality of pixels may be arranged in a matrix, and the data line signals supplied to the pixel electrodes may be switched to the data line signals of the positive polarity with respect to the potential of the counter electrodes and the data line signals of the negative polarity with respect to the potential of the counter electrodes, for each horizontal line of the plurality of pixels arranged in the matrix. By this configuration, since the data line signal corresponding to the high potential side and the data line signal corresponding to the low potential side are alternately supplied to the plurality of pixels for each horizontal line, it is possible to suppress generation of an image sticking phenomenon of liquid crystal.

In the configuration including the plurality of pixels, the capacitive line and the capacitive line control circuit may be provided one by one in the pixels of one row. By this configuration, it is possible to control the potential of the storage capacitors with certainty for every pixels of one row.

In the configuration including the plurality of pixels, the capacitive line and the capacitive line control circuit may be provided one by one in the pixels of a plurality of rows. By this configuration, since one capacitive line corresponds to the pixels of the plurality of rows, it is possible to suppress the increase in the number of capacitive lines. Therefore, it is possible to increase the transmissivity of the light source in each of the pixels by decreasing the number of capacitive lines. That is, it is possible to increase the aperture ratio of the pixels. In addition, it is possible to simplify the circuit configuration by decreasing the number of capacitive line control circuits.

In this case, a first writing mode for sequentially performing writing from the pixels of a previous stage to the pixels of a next stage one stage by one stage for each vertical period and a second writing mode for sequentially performing writing in order opposite to the first writing mode from the pixels of the previous stage to the pixels of the next stage for every two stages may be alternately performed at the time of writing the data line signals.

In the configuration including the plurality of pixels, the electro-optical device may further include gate line scanning units which scan the gate lines; and a display unit including the plurality of pixels, and the gate line scanning units may be arranged at positions sandwiching the display unit one by one. By this configuration, since two gate line scanning units are provided with the display unit interposed therebetween, the distance of the gate line from the gate line scanning unit to the pixels can be decreased compared with the case where one gate line scanning unit is arranged. Accordingly, it is possible to suppress the increase in wire resistance and wire capacity. As a result, since a time constant can be reduced, it is possible to write the data line signals to the pixels with accuracy.

According to a second aspect of the invention, there is provided an electronic apparatus including the electro-optical device having the above-described configuration. By this configuration, it is possible to obtain an electronic apparatus with low power consumption.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described with reference to the accompanying drawings.

First Embodiment

Figure 1:
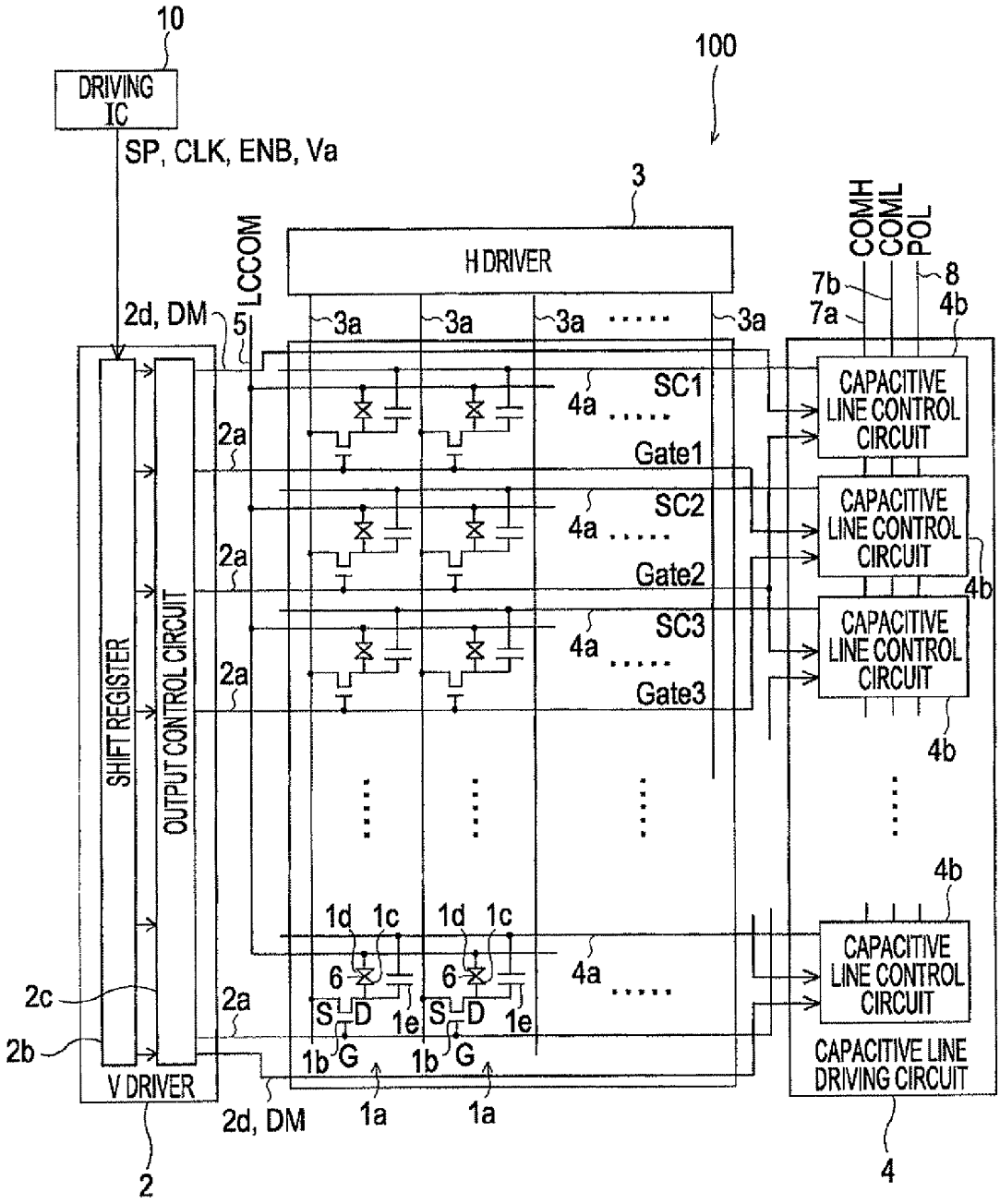
FIG. 1 is a block diagram showing the whole configuration of a liquid crystal display device according to a first embodiment of the invention.
Figure 2:
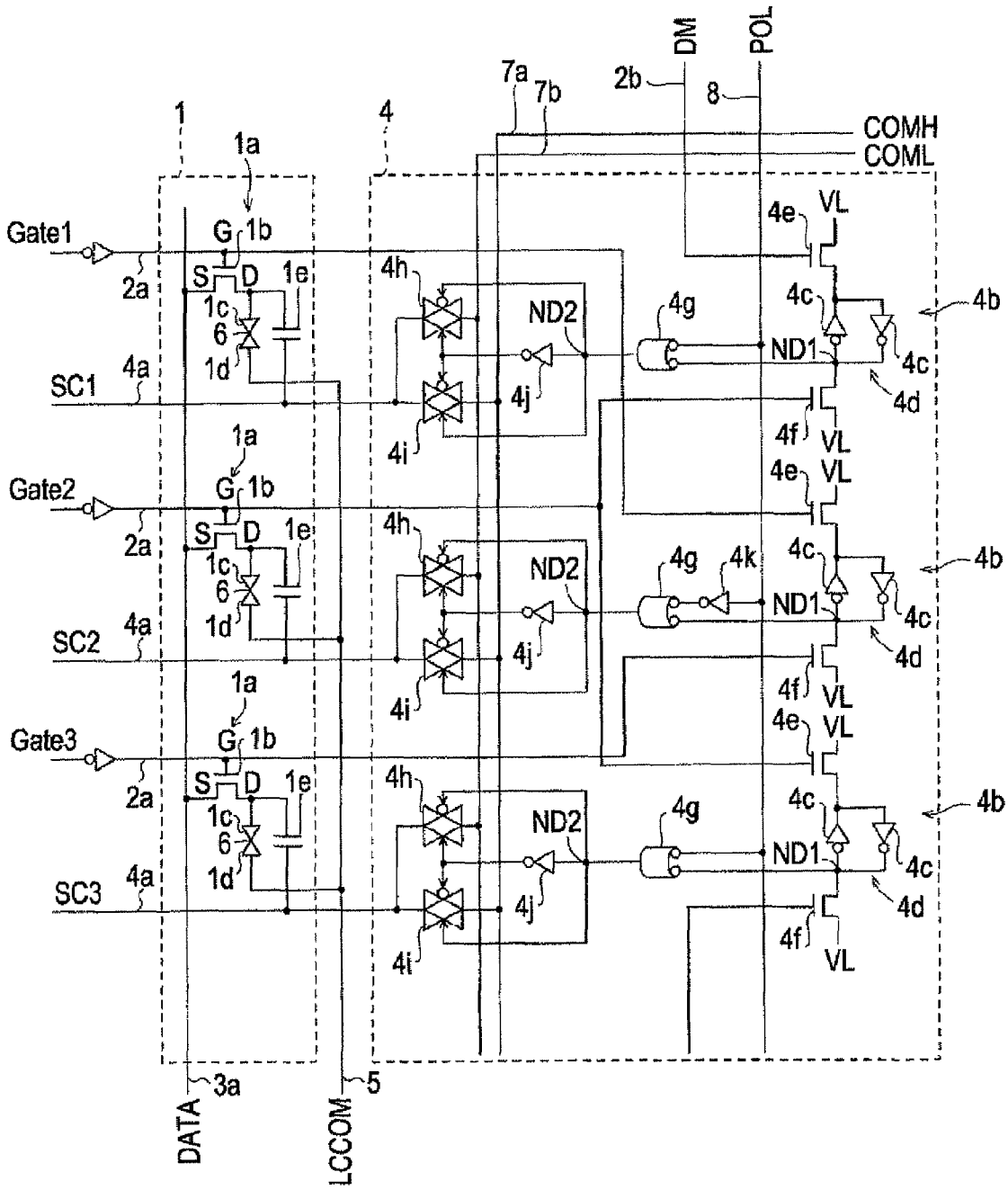
FIG. 2 is a circuit diagram showing the configuration of the liquid crystal display device according to the first embodiment of the invention.

FIG. 1 is a block diagram showing the whole configuration of a liquid crystal display device according to a first embodiment of the invention. FIG. 2 is a circuit diagram showing the detailed configuration of the liquid crystal display device according to the first embodiment of the invention. First, the configuration of the liquid crystal display device 100 according to the first embodiment of the invention will be described with reference to FIGS. 1 and 2. In addition, in the first embodiment, an example of applying the invention to a liquid crystal display device which is an example of an electro-optical device will be described.

The liquid crystal display device 100 according to the first embodiment of the invention includes, as shown in FIG. 1, a display screen unit 1, a V driver 2, an H driver 3, and a capacitive line driving circuit unit 4. In the display screen unit 1, a plurality of pixels 1*a* are arranged in a matrix. In addition, in FIG. 1, eight pixels La are shown for simplification of the drawing. In addition, the V driver 2 is an example of a "gate line scanning unit" of the invention.

A plurality of gate lines 2*a* and data lines 3*a* are connected to the V driver 2 and the H driver 3, respectively. The gate lines 2*a* and the data lines 3*a* are arranged to perpendicularly intersect each other. In addition, the pixels 1*a* are arranged at the positions where the gate lines 2*a* and the data lines 3*a* perpendicularly intersect each other.

The V driver 2 includes a shift register 2*b* and an output control circuit 2*c*, and functions as a driving circuit of the gate lines 2*a*. In detail, a sampling pulse (SP), a clock signal (CLK), an enable signal (ENB) and a driving power source potential (Va) are supplied from a driving IC 10 to the shift register 2*b* of the V driver 2, and output signals are generated from the shift register 2*b* on the basis of these signals and the driving power source potential. In addition, these output signals are sequentially supplied to the output control circuit 2*c*, and gate signals output from the output control circuit 2*c* to the gate lines 2*a*. In addition, the H driver 3 has a function for sequentially supplying video signals supplied from the driving IC 10 to the below-described pixel electrodes 1*c* via the data lines 3*a*. In addition, the driving IC 10 is an example of a "driving power source" of the invention and the video signals are an example of "data line signals" of the invention.

Each of the pixels 1*a* includes a pixel transistor 1*b* (TFT), a pixel electrode 1*c*, a counter electrode 1*d*, and a storage capacitor 1*e*. A source area S of the pixel transistor 1*b* is connected to the data line 3*a*, and a drain area D of the pixel transistor 1*b* is connected to one electrode of the pixel electrode 1*c* and one electrode of the storage capacitor 1*e* (which is an example of "one end of the storage capacitor" of the invention). In addition, a gate G of the pixel transistor 1*b* is connected to the gate line 2*a*. In addition, the counter electrode 1*d* is connected to a CON driver (not shown) via an LCCOM line 5. In addition, the other electrode of the storage capacitor 1*e* (which is an example of "the other end of the storage capacitor" of the invention) is connected to a capacitive line 4*a*, and the capacitive line 4*a* is connected to the capacitive line driving circuit unit 4. Liquid crystal 6 is filled between the pixel electrode 1*c* and the counter electrode 1*d*.

In the first embodiment, the capacitive line driving circuit unit 4 includes a plurality of capacitive line control circuits 4*b* which are respectively provided in the capacitive lines 4*a* (SC1, SC2, SC3, . . . of the drawing). Each of the capacitive line control circuits 4*b* has a function for driving the capacitive line 4*a* corresponding thereto. In the pixels 1*a* of one row, the capacitive line 4*a* and the capacitive line control circuit 4*b* are provided one by one.

The gate line 2*a* connected to the pixels 1*a* of the row of a previous stage and the gate line 2*a* connected to the pixels 1*a* of the row of a next stage are connected to each of the capacitive line control circuits 4*b*. In detail, for example, in FIG. 1, the gate line 2*a* (Gate1 of the drawing) connected to the pixels 1*a* of the row of the previous stage and the gate line 2*a* (Gate3 of the drawing) connected to the pixels 1*a* of the row of the next stage are connected to the capacitive line control circuit 4*b* corresponding to the pixels 1*a* of the row of a second stage.

In the first embodiment, the gate line 2*a* (Gate2 of the drawing) connected to the pixels 1*a* of the row of the next stage and a dummy gate line 2*d* (DM of the drawing) are connected to the capacitive line control circuit 4*b* corresponding to the pixels 1*a* of the row of a first stage.

In the first embodiment, a COMH line 7*a* for supplying a potential level (COMH of the drawing) of a COMH signal to the storage capacitor 1*e* via the capacitive line 4*a* and a COML line 7*b* for supplying a potential level (COML of the drawing) of a COML signal to the storage capacitor 1*e* via the capacitive lines 4*a* are connected to each of the capacitive line control circuits 4*b*. In addition, the COMH signal is a signal having an H level for changing the potential of the storage capacitor 1*e* to a high potential side, and the COML signal is a signal having an L level for changing the potential of the storage capacitor 1*e* to a low potential side (a low potential with respect to the high potential side). In addition, a POL line 8 which supplies a polarity selection signal (POL of the drawing) for selecting which of the COMH signal and the COML signal is output from each of the capacitive line control circuits 4*b* to the capacitive line 4*a* is connected to each of the capacitive line control circuits 4*b*.

As described above, each of the capacitive line control circuits 4*b* is configured to output any one of the COMH signal and the COML signal to the capacitive line 4*a* corresponding thereto on the basis of a dummy gate signal or the gate signal and the polarity selection signal. The detailed operation will be described later.

Next, the detailed circuit diagram of the capacitive line driving circuit unit 4 will be described. As shown in FIG. 2, the capacitive line control circuits 4*b* have different circuit configurations according to an odd-numbered stage and an even-numbered stage. First, the circuit configuration of the capacitive line control circuit 4*b* of the odd-numbered stage will be described. Each of the capacitive line control circuits 4*b* includes a latch circuit 4*d* including two inverters 4*c*, transistors 4*e* and 4*f*, a NAND circuit 4*g*, switches 4*h* and 4*i* including transfer gate transistors, and an inverter 4*j*. In addition, each of the switches 4*h* and 4*i* (transfer gate transistors) is configured by connecting an n-type MOS transistor and a p-type MOS transistor in parallel.

One of the source and the drain of the transistor 4*e* is connected to one connection portion of the latch circuit 4*d*, and a signal having the L level (VL of the drawing) is supplied to the other of the source and the drain of the transistor 4*e*. Similarly, one of the source and the drain of the transistor 4*f* is connected to the other connection portion of the latch circuit 4*d* via a node 1 (ND1). In addition, the signal having the L level (VL) is supplied to the other of the source and the drain of the transistor 4*f*.

The node 1 (ND1) which is the connection portion between the latch circuit 4*d* and the transistor 4*f* is connected to one input side of the NAND circuit 4*g*. In addition, the other input side of the NAND circuit 4*g* is connected to the POL line 8. The output side of the NAND circuit 4*g* is connected to the input side of the inverter 4*j* via a node 2 (ND2). In addition, the output side of the NAND circuit 4*g* is connected to the gate of the p-type transistor side of the switch 4*h* and the gate of the n-type transistor side of the switch 4*i*, at the node 2 (ND2). The output side of the inverter 4*j* is connected to the gate of the n-type transistor side of the switch 4*h* and the gate of the p-type transistor side of the switch 4*i*. One connection portion of the switch 4*h* is connected to the COML line 7*b* and the other connection portion thereof is connected to the capacitive line 4*a*. In addition, one connection of the switch 4*i* is connected to the COMH line 7*a* and the other connection portion thereof is connected to the capacitive line 4*a*.

The capacitive line control circuit 4*b* of the even-numbered stage has a configuration obtained by adding an inverter 4*k* to the configuration of the capacitive line control circuit 4*b* of the odd-numbered stage. In detail, for example, as shown in the capacitive line control circuit 4*b* of a second stage, the other input side of the NAND circuit 4*g* is connected to the output side of the inverter 4*k* and the input side of the inverter 4*k* is connected to the POL line 8.

In the capacitive line control circuits 4*b* of the odd-numbered stage and the even-numbered stage, the gate line 2*a* corresponding to the pixels 1*a* of the row of the previous stage is connected to the gate of the transistor 4*e*, and the gate line 2*a* corresponding to the pixels 1*a* of the row of the next stage is connected to the gate of the transistor 4*f*. In detail, for example, the gate line 2*a* corresponding to the pixels 1*a* of the row of the previous stage (the gate line 2*a* corresponding to Gate1) is connected to the gate of the transistor 4*e* in the capacitive line control circuit 4*b* of the second stage and the gate line 2*a* corresponding to the pixels 1*a* of the row of the next stage (the gate line 2*a* corresponding to Gate3) is connected to the gate of the transistor 4*f*. In addition, the dummy gate line 2*d* is connected to the gate of the transistor 4*e* in the capacitive line control circuit 4*b* of the first stage.

Figure 3:
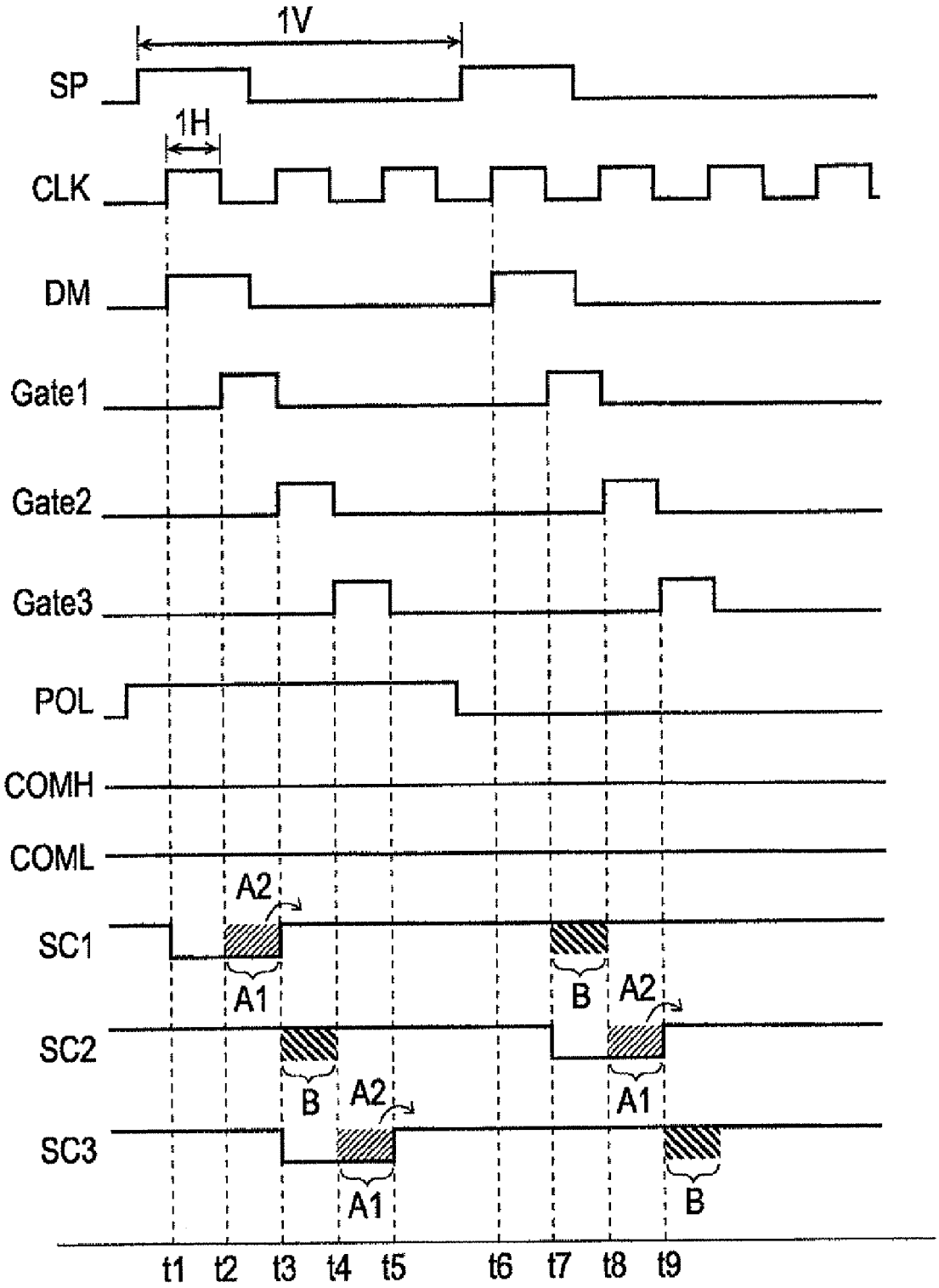
FIG. 3 is a timing chart explaining an operation when a video signal is written, in the liquid crystal display device according to the first embodiment of the invention.

FIG. 3 is a timing chart explaining an operation when a video signal is written, in the liquid crystal display device according to the first embodiment of the invention. FIGS. 4 to 7 are views explaining the detailed operation when the video signal is written, in the liquid crystal display device according to the first embodiment of the invention. Next, the operation when the video signal is written in the liquid crystal display device 100 according to the first embodiment of the invention will be described with reference to FIGS. 2 to 7.

First, as shown in FIG. 3, in one first vertical period (1V period of the drawing), the polarity selection signal (POL of FIG. 3) having the H level is continuously supplied from the POL line 8 (see FIG. 2). At this time, at a time t1, the dummy gate signal having the H level is supplied to the gate of the transistor 4*e* in the capacitive line control circuit 4*b* of the first stage via the dummy gate line 2*d* on the basis of the clock signal. Accordingly, the signal having the L level (VL of FIG. 2) is supplied to the latch circuit 4*d* via the source and the drain of the transistor 4*e*. At this time, the signal having the L level is inverted by the inverter 4*c* in the latch circuit 4*d* and is stored (latched) such that the node 1 (ND1) side of the latch circuit 4*d* is held at the H level. Accordingly, the signal having the H level is supplied from the latch circuit 4*d* to one input side of the NAND circuit 4*g* via the node 1 (ND1).

At this time, since the signal having the H level is supplied to the other input side of the NAND circuit 4*g* via the POL line 8, the signal having the L level is output from the output side of the NAND circuit 4*g*. The signal having the L level is supplied to the gates of the transistors respectively configuring the switch 4*h* and 4*i* via the node 2 (ND2). In the switch 4*i*, the signal having the L level is held at an OFF state so as to be supplied to the gate of the n-type MOS transistor side. In contrast, in the switch 4*h*, the signal having the L level is held at an ON state so as to be supplied to the gate of the p-type MOS transistor side. Accordingly, the COML signal (L level) is supplied from the COML line 7*b* to the capacitive line 4*a* of the first stage (SC1 of FIG. 2) via the switch 4*h* switched to the ON state. That is, at the time t1 of FIG. 3, SC1 (the potential of the capacitive line 4*a* of the first stage) is changed to the L level.

In the first embodiment, in this state, at a time t2 of FIG. 3, the gate line 2*a* (Gate1 of the drawing) corresponding to the pixels 1*a* of the row of first stage becomes the ON state such that the video signal is written to the pixels 1*a* of the row of the first stage. At this time, the video signal corresponding to the high potential side (the writing of the positive polarity with respect to the potential of the counter electrode 1*d*) is supplied to the pixels 1*a* of the row of the first stage. That is, the video signal corresponding to the high potential side is written when SC1 (the potential of the capacitive line 4*a* of the first stage) is at the L level (a portion A1 of FIG. 3). In addition, the video signal is written to the pixels 1*a* of the first stage in a period from the time t2 to a time t3 (a period in which Gate1 is in an ON state).

At the time t2, the ON signal supplied from the gate line 2*a* of Gate1 is input to the gate of the transistor 4*e* in the capacitive line control circuit 4*b* corresponding to the capacitive line 4*a* of the second stage (SC2 of FIG. 2), as shown in FIG. 2. Accordingly, the signal having the L level is supplied to the latch circuit 4*d* via the source and the drain of the transistor 4*e* and is stored in the latch circuit 4*d* such that the node 1 (ND1) side becomes the H level. The signal having the H level is input from the latch circuit 4*d* to one input side of the NAND circuit 4*g* in the capacitive line control circuit 4*b* of the second stage via the node 1 (ND1).

The signal having the H level supplied from the POL line 8 is inverted to the L level state by the inverter 4*k* and is supplied to the other input side of the NAND circuit 4*g*. Accordingly, the signal of the H level is output from the output side of the NAND circuit 4*g* and the signal having the H level is input to the gate of the n-type transistor side of the switch 4*i* such that the switch 4*i* in the capacitive line control circuit 4*b* of the second stage becomes the ON state. In addition, the switch 4*h* is held at the OFF state. The COMH signal (H level) from the COMH line 7*a* is supplied to the capacitive line 4*a* of the second stage (SC2 of FIG. 2) via the switch 4*i*. That is, at the time t2 of FIG. 3, SC2 (the potential of the capacitive line 4*a* of the second stage) is held at the H level state.

At the time t3 of FIG. 3, the writing of the video signal to the pixels 1*a* of the first stage is finished and the gate signal having the H level is supplied from the gate line 2*a* (Gate2) corresponding to the pixels 1*a* of the second stage.

At this timer in the first embodiment, the gate signal output from the gate line 2*a* corresponding to Gate2 is supplied to the gate of the transistor 4*f* in the capacitive line control circuit 4*b* of the first stage. Accordingly, the signal having the L level (VL of the drawing) is supplied to the latch circuit 4*d* via the source and the drain of the transistor 4*f*. The signal having the L level is stored in the latch circuit 4*d* such that the node 1 (ND1) side becomes the L level state, and is supplied to one input side of the NAND circuit 4*g* via the node 1 (ND1) Accordingly, the signal having the H level is continuously supplied from the POL line 8 to the other input side of the NAND circuit 4*g* such that the signal having the H level is output from the output side of the NAND circuit 4*g*.

By the signal having the H level, the switch 4*i* is turned on and the switch 4*h* is turned off. Accordingly, the COMH signal (H level) is supplied to the capacitive line 4*a* of the first stage via the switch 4*i*. That is, at the time t3 of FIG. 3, the potential of the storage capacitor 1*e* corresponding to the capacitive line 4*a* of the first stage (SC1 of FIG. 3) is changed from the low potential side to the high potential side. Accordingly, the potential of the pixel electrodes 1*c* of the pixels 1*a* of the row of the first stage, to which the video signal corresponding to the high potential side (the writing of the positive polarity with respect to the potential of the counter electrode 1*d*) is written, is changed to the high potential side by the change in potential of the storage capacitor 1*e* to the high potential (the voltage corresponding to the potential of the COMH signal—the potential of the COML signal) (a portion A2 of FIG. 3).

In the first embodiment, at the time t3, the writing of the video signal to the pixels 1*a* of the row of the second stage is performed. The video signal corresponding to the low potential side (the writing of the negative polarity with respect to the potential of the counter electrode 1*d*) is supplied to the pixels 1*a* of the row of the second stage. That is, the liquid crystal display device 100 of the first embodiment is driven by one horizontal period inversion driving, in which the video signal supplied to the pixel electrodes 1*c* can be switched between the high potential side and the low potential side, for every row of the pixels 1*a*. At this time, the potential of the capacitive line 4*a* of the second stage (SC2) is held at the high potential side. That is, with respect to the pixels 1*a* of the row of the second stage, the video signal corresponding to the low potential side (the writing of the negative polarity with respect to the potential of the counter electrode 1*d*) is written to the pixel electrodes 1*c*, in a state in which the potential of the storage capacitor 1*e* is held at the high potential side (a portion B of FIG. 3).

At this time, at the time t3, the ON signal output from the gate line 2*a* corresponding to Gate2 is supplied to the gate of the transistor 4*e* in the capacitive line control circuit 4*b* of the third stage. Accordingly, in the capacitive line control circuit 4*b* of the third stage, the same operation as the operation of the capacitive line control circuit 4*b* of the first stage is performed. That is, the switch 4*h* becomes the ON state and the COML signal (L level) is supplied to the capacitive line 4*a* of the third stage (SC3 of FIG. 2) via the switch 4*h*. Accordingly, the potential of SC3 (the potential of the capacitive line 4*a* of the third stage) of FIG. 3 becomes the L level at the time t3.

In this state, at a time t4, the ON signal is supplied to the gate line 2*a* corresponding to the pixels 1*a* of the third stage (Gate3 of FIG. 2) and the writing of the video signal is performed with respect to the pixels 1*a* of the third stage. The video signal corresponding to the high potential side is written in the pixels 1*a* of the third stage by one horizontal period inversion driving, similar to the pixels 1*a* of the first stage.

At a time t5, the ON signal supplied to the gate line 2*a* corresponding to the pixels 1*a* of the third stage becomes the OFF state and the ON signal is supplied from the gate line 2*a* corresponding to the pixels 1*a* of the fourth stage (Gate4 (not shown)). This ON signal is supplied to the gate of the transistor 4*f* in the capacitive line control circuit 4*b* of the third stage such that the same operation as the capacitive line control circuit 4*b* of the first stage at the time t3 is performed. That is, the potential of the capacitive line 4*a* of the third stage held at the low potential side is changed to the high potential side such that the potential of the pixel electrodes 1*c* of the pixels 1*a* of the third stage, to which the video signal corresponding to the high potential side is written, is changed to the high potential side by the voltage corresponding to the transition (the potential of the COMH signal—the potential of the COML signal) of the capacitive line 4*a*.

Accordingly, in the first embodiment, the pixels 1*a* of the odd-numbered stage are controlled such that the video signal corresponding to the high potential side (the writing of the positive polarity with respect to the potential of the counter electrode) is written in a state in which the potential of the storage capacitor 1*e* is held at the low potential side, and the potential of the storage capacitor 1*e* is changed from the low potential side to the high potential side after the writing of the video signal. In addition, the pixels 1*a* of the even-numbered stage are controlled such that the video signal corresponding to the low potential side (the writing of the negative polarity with respect to the potential of the counter electrode) is written in a state in which the potential of the storage capacitor 1*e* is held at the high potential side.

The potential change at the time of writing the video signal (the video signal corresponding to the high potential side) to the pixels 1*a* of the odd-numbered stage will be described in detail.

Figure 4:
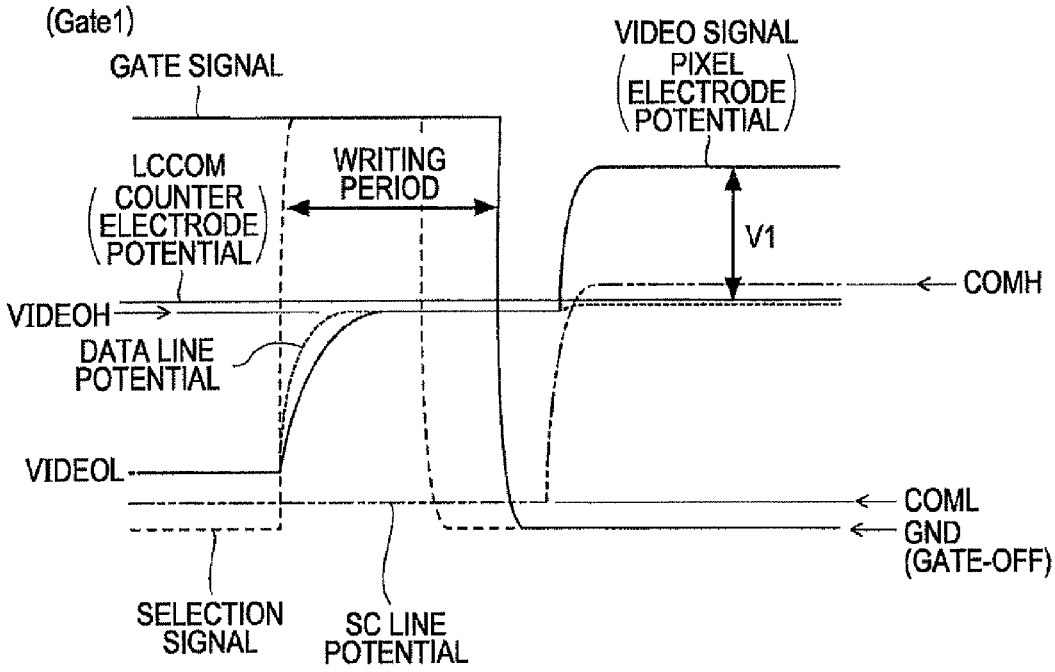
FIG. 4 is a view explaining a potential change when the video signal is written, in the liquid crystal display device according to the first embodiment of the invention.

First, a case of writing a video signal corresponding to a white display in a normally-black mode will be described with reference to FIG. 4. For example, when the gate line 2*a* corresponding to Gate1 (the gate line 2*a* corresponding to the pixels 1*a* of the first stage) is in the ON state, the writing of the video signal to the pixels 1*a*, to which a selection signal having the H level is supplied, is performed. The selection signal is a signal for selecting the pixels 1*a* to which the video signal is written.

In detail, the video signal corresponding to the white display is supplied to the data line 3*a* such that the video signal is supplied to the pixel electrodes 1*c* via the data line 3*a*. Accordingly, in a writing period of FIG. 4, the potentials of the data line 3*a* and the pixel electrodes 1*c* become a level of VIDEOH. At this time, the potential of the capacitive line 4*a* of the first stage (the potential of the line SC of the drawing) is held at the level (L level) of COML. In addition, the gate signal becomes the OFF state, and the potential of the capacitive line 4*a* is changed from the COML state to the COMH state. Accordingly, the potential of the pixel electrodes 1*c* is changed to the high potential side.

At this time, the gate signal is in the OFF state and thus the pixel transistors 1*b* are in the OFF state. Accordingly, the potential of the data line 3*a* is hardly changed. Therefore, a difference between the potential of the counter electrode 1*d* held at a constant level (LCCOM of the drawing) and the potential of the pixel electrodes 1*c* changed to the high potential side (V1 of the drawing (a potential difference corresponding to the white display)) is applied to the liquid crystal 6.

Figure 5:
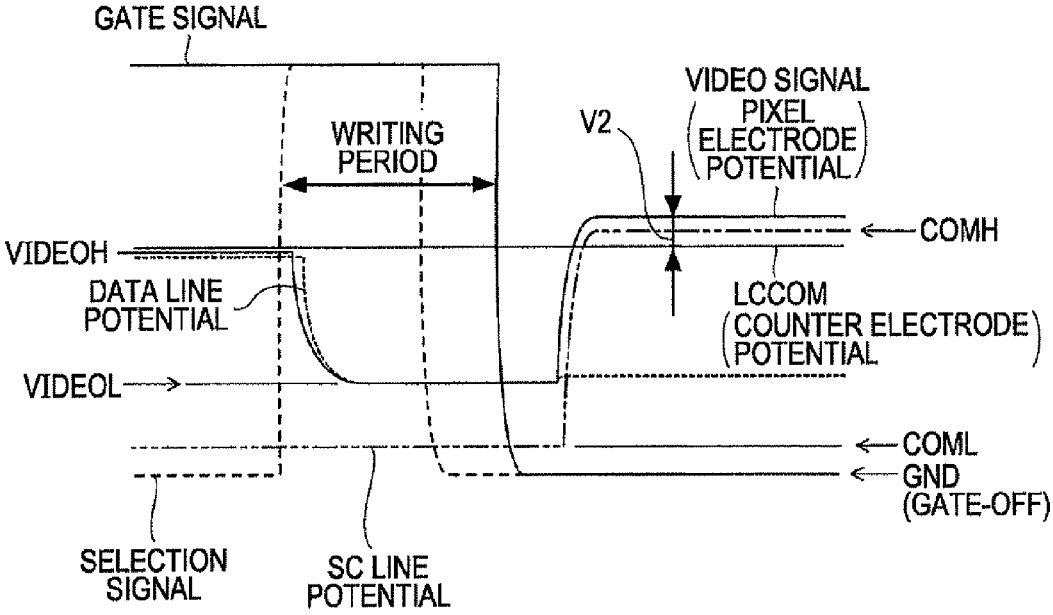
FIG. 5 is a view explaining a potential change when the video signal is written, in the liquid crystal display device according to the first embodiment of the invention.

As shown in FIG. 5, when a video signal corresponding to a black display in a normally-black mode is written, similar to the above description, the video signal is written in a writing period of the drawing. Accordingly, in the writing period, the potentials of the data line 3*a* and the pixel electrodes 1*c* become a level of VIDEOL, and the potential of the capacitive line 4*a* of the first stage (the potential of the line SC of the drawing) is held at the level (L level) of COML. In addition, the gate signal becomes the OFF state, and the potential of the capacitive line 4*a* is changed from the COML state to the COMH state. Accordingly, the potential of the pixel electrodes 1*c* is changed to the high potential side. Therefore, a difference between the potential of the counter electrode 1*d* (LCCOM of the drawing) and the potential of the pixel electrodes 1*c* changed to the high potential side (V2 of the drawing (a potential difference corresponding to the black display)) is applied to the liquid crystal 6.

Next, the potential change at the time of writing the video signal (the low potential side) to the pixels 1*a* of the even-numbered stage will be described in detail.

Figure 6:
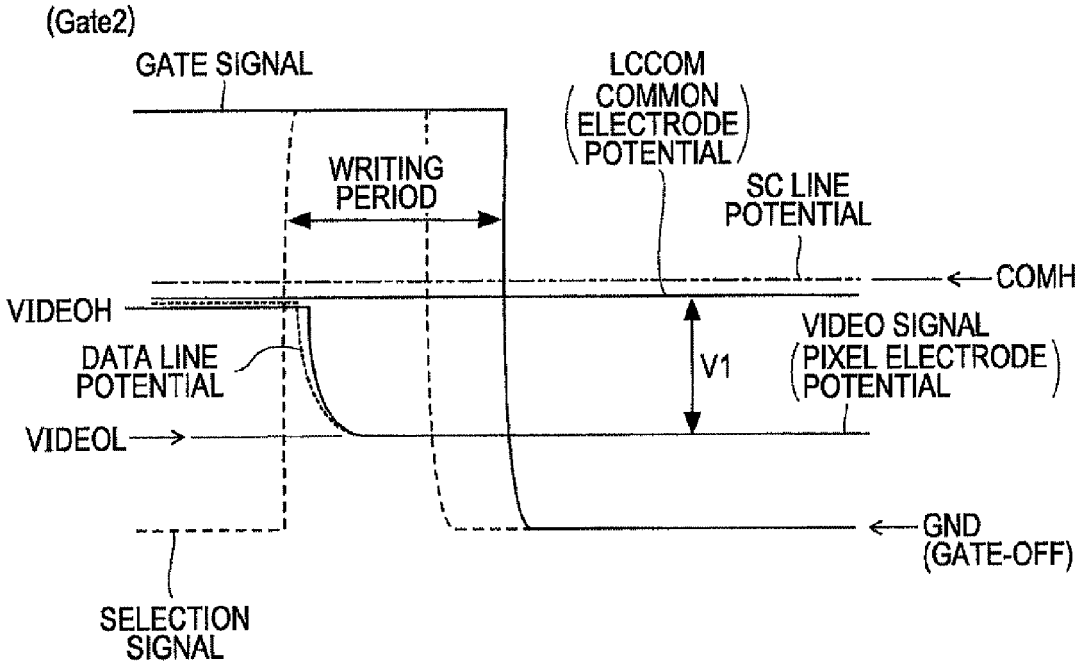
FIG. 6 is a view explaining a potential change when the video signal is written, in the liquid crystal display device according to the first embodiment of the invention.

First, a case of writing a video signal corresponding to a white display in a normally-black mode will be described with reference to FIG. 6. For example, when the gate line 2*a* corresponding to Gate2 (the gate line 2*a* corresponding to the pixels 1*a* of the first stage) is in the ON state, the writing of the video signal is performed similar to the above description. In detail, in a writing period of FIG. 6, the potentials of the data line 3*a* and the pixel electrodes 1*c* become a level of VIDEOL. At this time, the potential of the capacitive line 4*a* of the second stage (the potential of the line SC of the drawing) is held at the level (H level) of COMH even after the gate signal becomes the OFF state. Accordingly, even after the writing of the video signal is finished, the potential of the capacitive line 4*a* is continuously held at the COMH state and thus the potential of the pixel electrodes 1*c* is not changed. In addition, since the pixel transistors 1*b* are in the OFF state, the potential of the data line 3*a* is hardly changed. Therefore, a difference between the potential of the counter electrode 1*d* held at a constant level (LCCOM of the drawing) and the potential of the pixel electrodes 1*c* (V1 of the drawing (a potential difference corresponding to the white display)) is applied to the liquid crystal 6.

Figure 7:
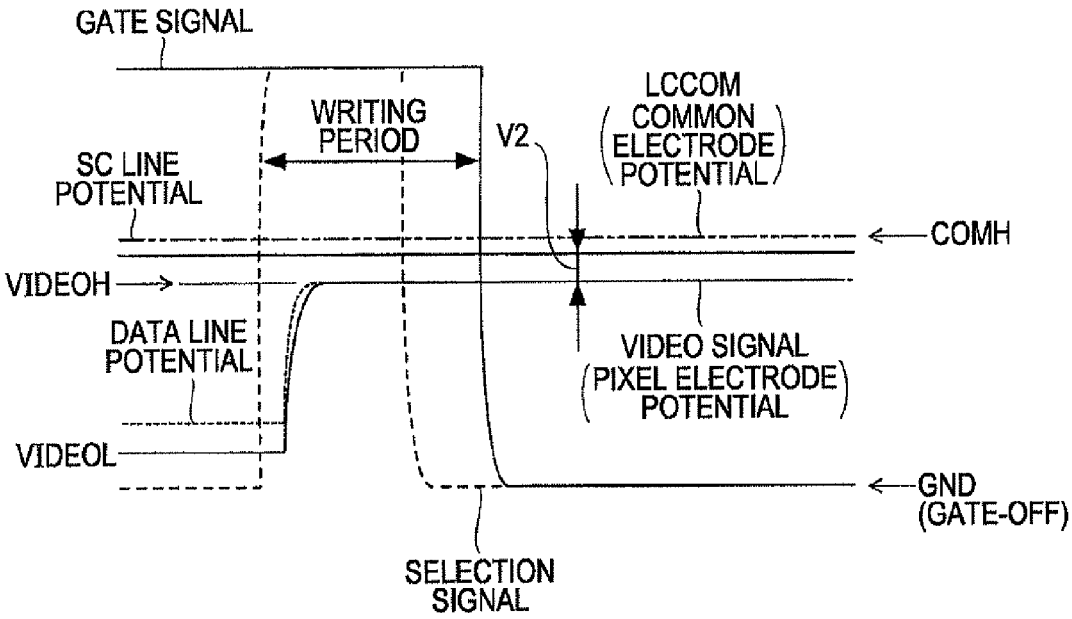
FIG. 7 is a view explaining a potential change when the video signal is written, in the liquid crystal display device according to the first embodiment of the invention.

As shown in FIG. 7, when a video signal corresponding to a black display in a normally-black mode is written, similar to the above description, in the writing period, the potentials of the data line 3*a* and the pixel electrodes 1*c* become a level of VIDEOH, and the potential of the capacitive line 4*a* of the second stage (the potential of the line SC of the drawing) is held at the level (H level) of COMH. In addition, the gate signal becomes the OFF state, and the writing of the video signal (black display) is finished. Even after the writing of the video signal is finished, the potential of the capacitive line 4*a* is continuously held at the COMH state and thus the potential of the pixel electrodes 1*c* is not changed. Therefore, a difference between the potential of the counter electrode 1*d* (LCCOM of the drawing) and the potential of the pixel electrodes 1*c* (V2 of the drawing (a potential difference corresponding to the black display)) is applied to the liquid crystal 6.

In the first embodiment, as shown in FIGS. 4 to 7, the OFF potential of the gate signal is a reference potential of the liquid crystal display device, that is, the same potential as a ground level (GND). Accordingly, in the liquid crystal display device 100 of the first embodiment, the operation for writing the video signal is performed by the potential of the positive polarity side with respect to the reference potential. In addition, the ground level (GND) is the reference potential when an electrical signal is exchanged, and may be called a ground potential or a low potential of a driving power source of the V driver 2.

As shown in FIG. 3, in one next vertical period (in and after a time t6), the polarity selection signal having the L level (POL of FIG. 3) is continuously supplied. In addition, the video signal corresponding to the low potential side is written to the pixels 1*a* of the odd-numbered stage, and the video signal corresponding to the high potential side is written to the pixels 1*a* of the even-numbered stage. In detail, the signal having the L level is supplied from the POL line 8 and, at the time t6, the dummy gate signal having the H level is supplied from the dummy gate line 2*d* to the gate of the transistor 4*e* in the capacitive line control circuit 4T of the first stage. Accordingly, the signal having the L level (VL) is supplied to the latch circuit 4*d* and the node 1 (ND1) side is inverted to the H level by the inverter 4*c* of the latch circuit 4*d*. The signal having the H level is supplied to one input side of the NAND circuit 4*g* and the signal (POL) having the L level is supplied to the other input side thereof such that the signal having the H level is output from the output side of the NAND circuit 4*g*. Accordingly, only the switch 4*i* becomes the ON state and the COMH signal (H level) is supplied to the capacitive line 4*a* (SC1) via the switch 4*i*. That is, at the time t6 shown in FIG. 3, the potential of the capacitive line 4*a* of the first stage (SC1) is continuously held at the H level.

At a time t7, the gate signal from Gate1 is supplied to the gate of the transistor 4*e* in the capacitive line control circuit 4*b* of the second stage such that the potential of the capacitive line 4*a* of the second stage (SC2) becomes the L level state. The gate line 2*a* corresponding to the pixels 1*a* of the first stage becomes the ON state by the gate signal from Gate1 such that the writing of the video signal is started. At this time, the video signal corresponding to the low potential side is supplied to the pixels 1*a* of the first stage. When the writing of the video signal to the pixels 1*a* of the first stage is performed, the potential of the capacitive line 4*a* is continuously held at the H level state.

At a time t8, the gate line 2*a* (Gate2) corresponding to the pixels 1*a* of the second stage becomes the ON state such that the video signal corresponding to the high potential side is written in a state in which the potential of the capacitive line 4*a* is held at the L level. At a time t9, the gate signal of the ON state is output from the gate line 2*a* (Gate3) corresponding to the pixels 1*a* of the third stage and the gate signal is supplied to the gate of the transistor 4*f* in the capacitive line control circuit 4*b* of the second stage. Accordingly, the potential of the capacitive line 4*a* of the second stage (SC2) and the potential of the pixel electrodes 1*c* of the pixels 1*a* of the second stage is changed to the high potential side (a portion A2 of the drawing). At this time, the video signal is written to the pixels 1*a* of the third stage (a portion B of the drawing).

As described above, in the first embodiment, the video signal corresponding to the high potential side and the video signal corresponding to the low potential side are alternately supplied to the pixels 1*a* of the odd-numbered stage and the pixels 1*a* of the even-numbered stage for each vertical period.

Figure 8:
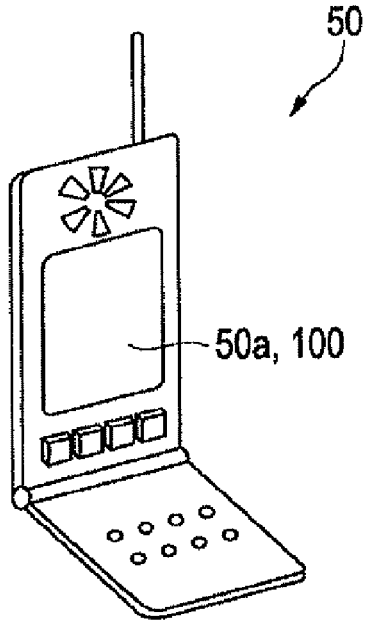
FIG. 8 is a view showing an example of an electronic apparatus using the liquid crystal display device according to the first embodiment of the invention.
Figure 9:
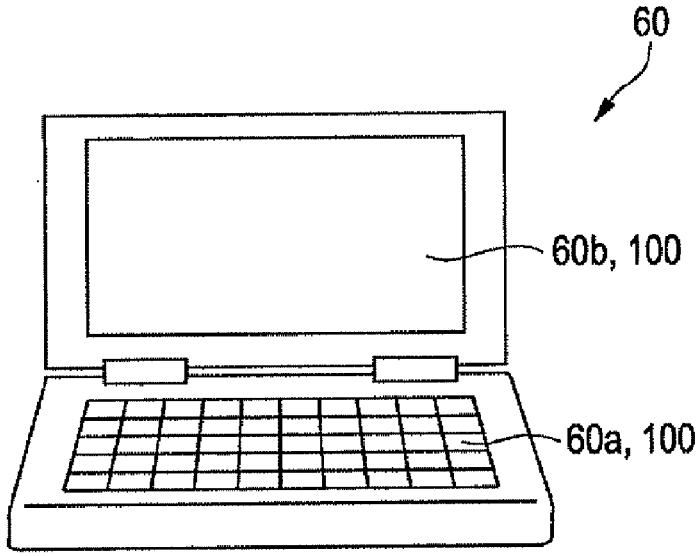
FIG. 9 is a view showing an example of an electronic apparatus using the liquid crystal display device according to an embodiment of the invention.

The liquid crystal display device 100 according to the first embodiment of the invention can be used in a mobile telephone 50, a personal computer (PC) 60 and so on, as shown in FIGS. 8 and 9. In the mobile telephone 50 of FIG. 8, the liquid crystal display device 100 of the first embodiment of the invention is used in a display screen 50*a*. In the PC 60 of FIG. 9, the liquid crystal display device can be used in an input unit such as a keyboard 60*a* or the like and a display screen 60*b* or the like. When a peripheral circuit is built in a substrate of a liquid crystal panel, it is possible to significantly decrease the number of components and realize reduction of the weight and the size of the device main body.

In the first embodiment, as described above, if the video signal written to the pixel electrodes 1*c* corresponds to the low potential side (the writing of the negative polarity with respect to the potential of the counter electrode 1*d*), the video signal is controlled to be written in a state in which the potential of the storage capacitor 1*e* is held at a constant level (LCCOM), unlike the case where the written video signal corresponds to the high potential side (the writing of the positive polarity with respect to the potential of the counter electrode 1*d*). That is, since the writing of the video signal is performed without changing the potential of the pixel electrodes 1*c* to the low potential side, the amplitude of the potential change of the pixel electrodes 1*c* can be reduced. Accordingly, since the amplitude of the gate signal for controlling the ON/OFF of the writing of the video signal can be decreased, it is possible to reduce power consumption at the time of writing the video signal.

In the first embodiment, since the OFF potential of the gate signal supplied to the pixel transistors 1*b* becomes the reference potential of the liquid crystal display device, that is, the same potential as the ground level (GND), such that the ON potential and the OFF potential of the gate signal only in the high potential side (the positive polarity side) with respect to the reference potential are controlled, it is possible to drive the gate line 2*a* without separately providing the power source of the low potential side (the negative polarity side) with respect to the reference potential. Accordingly, it is possible to suppress the increase in the number of power sources. In addition, the ground level (GND) is the reference potential when the electrical signal is exchanged and may be called the ground potential or the low potential of the driving power source of the V driver 2. Even in this case, since the gate line 2*a* can be driven without separately providing the power source of the low potential side (the negative polarity side) with respect to the low potential of the driving power source or the ground potential, it is possible to suppress the increase in the number of power sources.

In the first embodiment, since the potential of the storage capacitor 1*e* is controlled by the gate signal without separately generating the signal for controlling the potential of the storage capacitor 1*e* by connecting the capacitive line control circuit 4*b* to the gate line 2*a* and controlling the potential of the storage capacitor 1*e* on the basis of the gate signal supplied from the gate line 2*a*, it is possible to suppress the complication of the circuit.

In the first embodiment, in the capacitive line 4*a* of the first stage, by supplying the dummy gate signal to the capacitive line control circuit 4*b* of the first stage and controlling the potential of the storage capacitor 1*e* corresponding to the capacitive line 4*a* of the first stage on the basis of the dummy gate signal from the capacitive line control circuit 4*b* of the first stager it is possible to easily control the potential of the storage capacitor 1*e* corresponding to the capacitive line 4*a* of the first stage on the basis of the dummy gate signal.

In the first embodiment, since the video signal corresponding to the high potential side and the video signal corresponding to the low potential side are alternately supplied in a 1 H period by switching the video signal supplied to the pixel electrodes 1*c* to the video signal corresponding to the high potential side (the writing of the positive polarity with respect to the potential of the counter electrode) and the video signal corresponding to the low potential side (the writing of the negative polarity with respect to the potential of the counter electrode) for each horizontal period (1 H period) so as to perform the writing, it is possible to suppress the generation of an image sticking phenomenon of the liquid crystal 6.

In the first embodiment, by providing the capacitive line 4*a* and the capacitive line control circuit 4*b* one by one in the pixels 1*a* of one row, it is possible to control the potential of the storage capacitor 1*e* with certainty.

Second Embodiment

Figure 10:
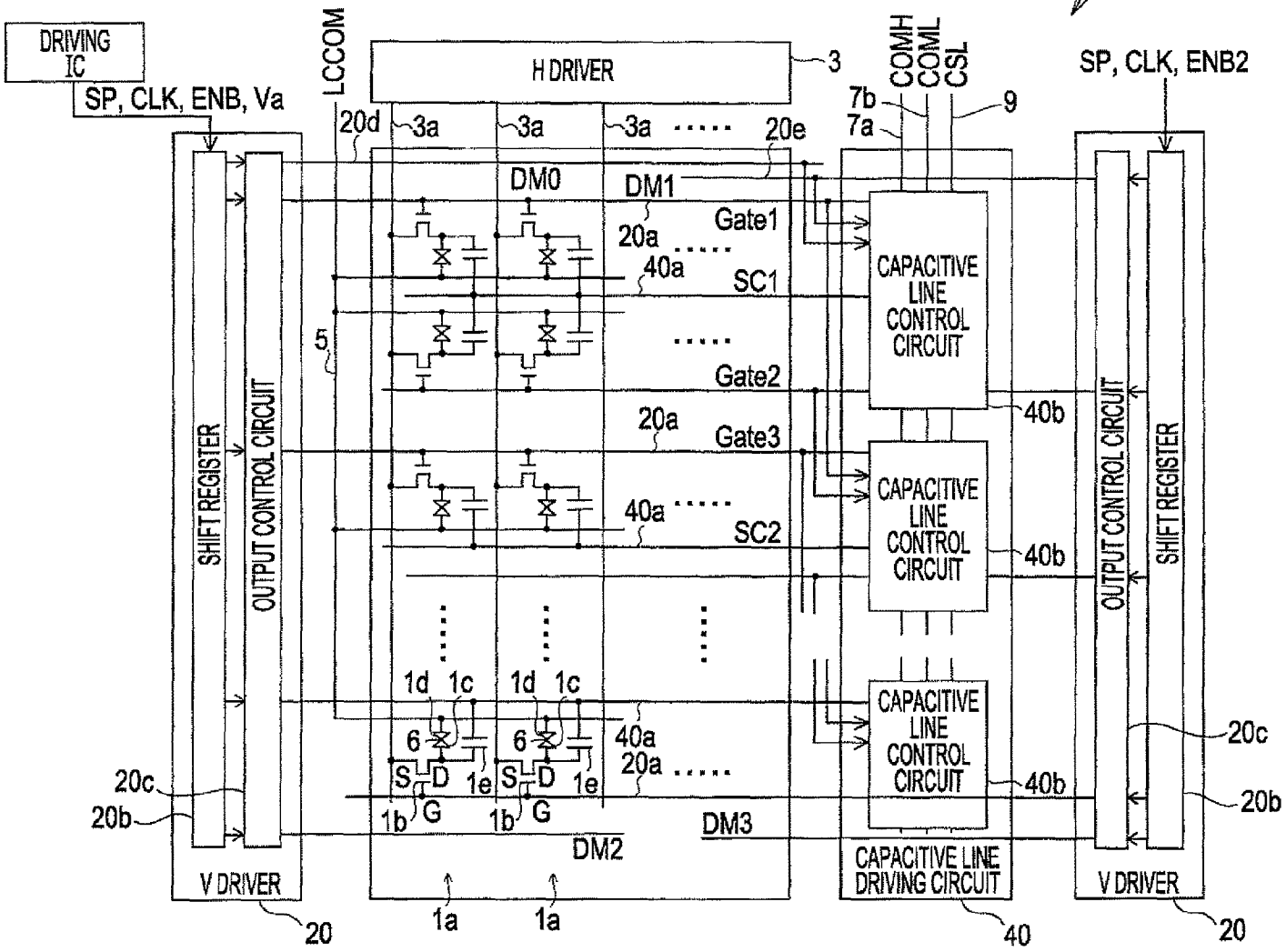
FIG. 10 is a block diagram showing the whole configuration of a liquid crystal display device according to a second embodiment of the invention.
Figure 11:
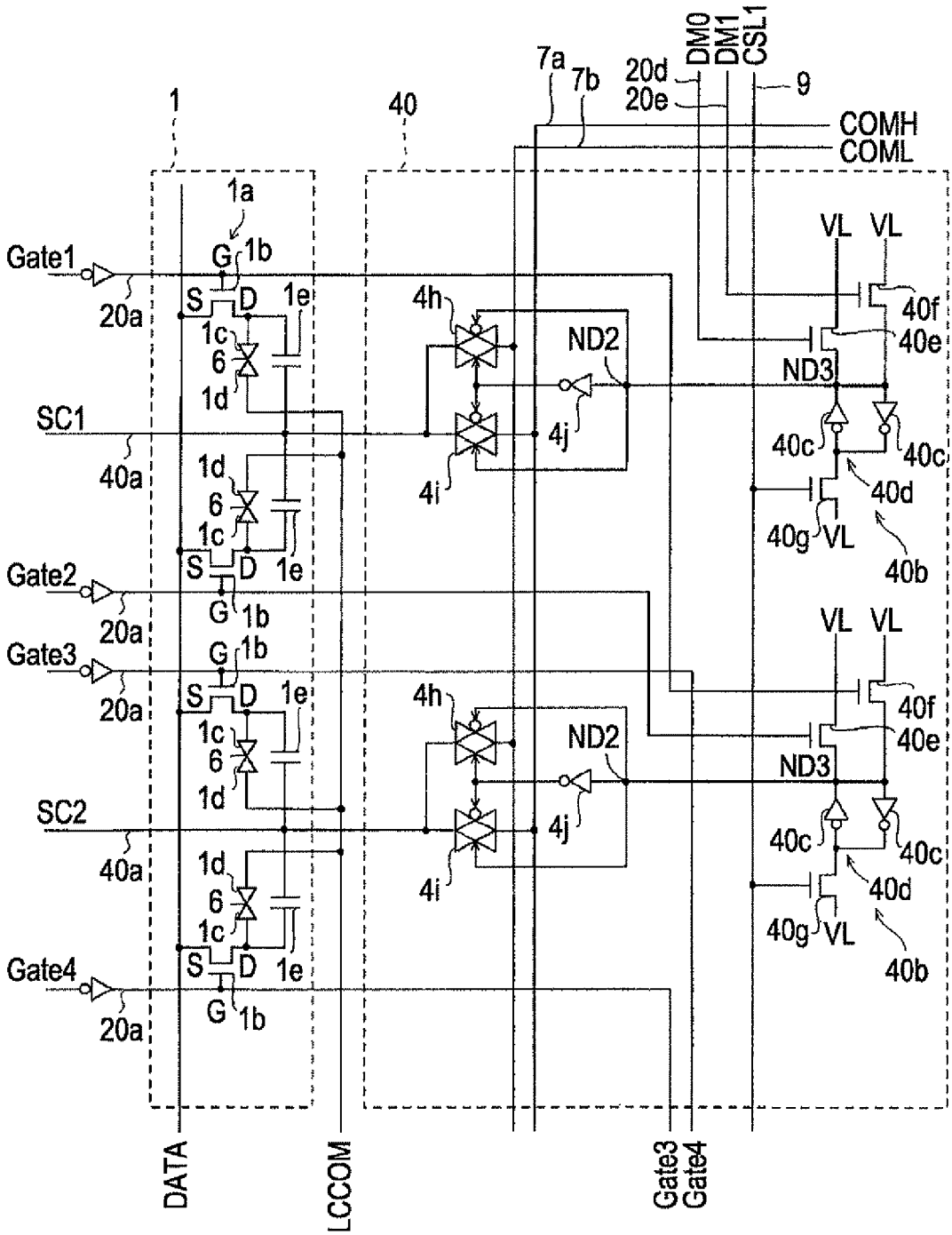
FIG. 11 is a circuit diagram showing the configuration of the liquid crystal display device according to the second embodiment of the invention.

FIGS. 10 and 11 are views explaining the configuration of a liquid crystal display device according to a second embodiment of the invention. In the second embodiment, an example of providing a capacitive line 40*a* and a capacitive line control circuit 40*b* in the pixels 1*a* of two rows will be described with reference to FIGS. 10 and 11, unlike the first embodiment in which the capacitive line 4*a* and the capacitive line control circuit 4*b* are provided one by one in the pixels 1*a* of one row.

In the liquid crystal display device 200 of the second embodiment of the invention, as shown in FIG. 10, V drivers 20 including gate lines 20*a* are arranged one by one with the display screen unit 1 interposed therebetween. Each of the V drivers 20 includes a shift register 20*b* and an output control circuit 20*c*, and a sampling pulse (SP), a clock signal (CLK), an enable signal (ENB) and a driving power source potential (Va) are supplied from the driving IC 10. The gate lines 20*a* provided in one V driver 20 are respectively connected to the pixels 1*a* of the odd-numbered stage and the gate lines 20*a* provided in the other V driver 20 are respectively connected to the pixels 1*a* of the even-numbered stage. That is, the number of gate lines 20*a* driven by one V driver 20 of the second embodiment is a half of the number of gate lines 2*a* driven by the V driver 2 of the first embodiment.

In the second embodiment, the capacitive line driving circuit unit 40 is included, and, in the capacitive line driving circuit unit 40, the capacitive line 40*a* and the capacitive line control circuit 40*b* are provided one by one in the pixels 1*a* of two rows. Two gate lines 20*a* connected to the pixels 1*a* of two rows corresponding thereto are connected to each capacitive line control circuit 40*b*. In addition, a CSL line 9 for supplying a CSL signal is connected to each capacitive line control circuit 40*b*. The CSL signal has a function for driving each capacitive line control circuit 40*b*. In the second embodiment, the capacitive line control circuit 40*b* and the capacitive line 40*a* are driven on the basis of the CSL signal and the gate signal.

A dummy gate line 20*d* (DM0 of FIG. 10) and a dummy gate line 20*e* (DM1 of FIG. 10) are connected to the capacitive line control circuit 40*b* corresponding to the capacitive line 40*a* of a first stage (SC1 of FIG. 10). In addition, the dummy gate line 20*d* is connected to one V driver 20 and the dummy gate line 20*e* is connected to the other V driver 20.

Next, the detailed circuit diagram of the capacitive line driving circuit unit 40 of the second embodiment will be described. As shown in FIG. 11, all the capacitive line control circuit 40*b* have the same circuit configuration unlike the first embodiment in which the circuit configurations of the odd-numbered stage and the even-numbered stage are different from each other. In detail, each of the capacitive line control circuits 40*b* includes a latch circuit 40*d* including two inverters 40*c* and transistors 40*e*, 40*f* and 40*g*, and includes switches 4*h* and 4*i* including transfer gate transistors similar to the first embodiment.

One of the source and the drain of each of the transistors 40*e* and 40*f* is connected to one side of the latch circuit 40*d* via a node 3 (ND3). A signal having an L level (VL of the drawing) is supplied to the other of the source and the drain of each of the transistors 40*e* and 40*f*. In addition, the signal having the L level (VL of the drawing) is supplied to the other side of the latch circuit 40*d*. The dummy gate line 20*d* is connected to the gate of the transistor 40*e*, and the dummy gate line 20*e* is connected to the gate of the transistor 40*f*. In addition, the CSL line 9 is connected to the gate of the transistor 40*g*.

A node 2 (ND2) and a node 3 (ND3) are connected to each other. Accordingly, the latch circuit 40*d* is connected to the switch 4*h*, the switch 4*i* and an inverter 4*j* via the node 2 (ND2) and the node 3 (ND3).

The other configuration is equal to that of the first embodiment.

Next, the operation when the video signal is written in the liquid crystal display device 200 according to the second embodiment of the invention will be described with reference to FIGS. 11 and 12.

Figure 12:
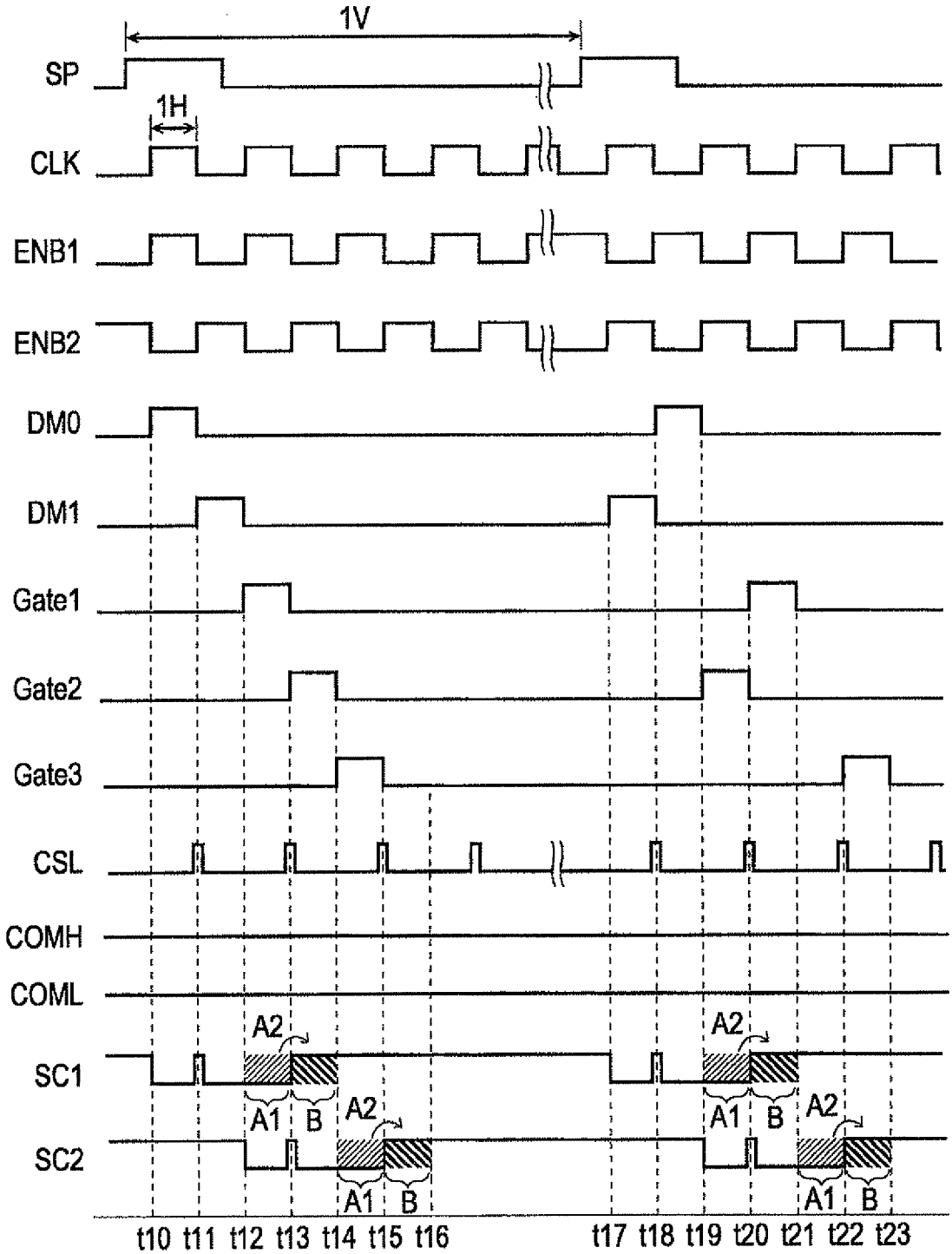
FIG. 12 is a timing chart explaining an operation when a video signal is written, in the liquid crystal display device according to the second embodiment of the invention.

First, as shown in FIG. 12, in one first vertical period (1V period), an ON signal is output from the CSL line 9 for every two horizontal periods (2 H periods). At this time, at a time t10, a dummy gate signal (DM0) having an H level is supplied to the gate of the transistor 40*e* in the capacitive line control circuit 40*b* of the first stage via the dummy gate line 20*d* (see FIG. 11) on the basis of the clock signal. Accordingly, the signal having the L level (VL of FIG. 11) is stored in the latch circuit 40*d* via the source and the drain of the transistor 40*e*. At this time, the signal having the L level is supplied to the switches 4*h* and 4*i* via the node 3 (ND3) and the node 2 (ND2), and only the switch 4*h* is switched to the ON state. A COML signal is supplied to the capacitive line 40*a* (SC1) of the first stage via the switch 4*h*. That is, at a time t10, the potential of the capacitive line 40*a* of the first stage (the potential of SC1) becomes the L level state.

Next, at a time t11, the ON signal is supplied from the CSL line 9 to the gate of the transistor 40*g*. Accordingly, the signal having the L level is supplied to the latch circuit 40*d* via the source and the drain of the transistor 40*g* and the node 3 (ND3) of the latch circuit 40*d* becomes the H level state. Accordingly, at the time t11, the signal having the H level is supplied to the switch 4*i* only in the period in which the CSL signal is in the ON state, and thus the switch 4*i* becomes the ON state. A COMH signal (H level) is supplied to the capacitive line 40*a* of the first stage via the switch 4*i*. Accordingly, at the time t1 of FIG. 12, the potential of the capacitive line 40*a* of the first stage (SC1) becomes the H level in the same period as the period in which the CSL signal is in the ON state.

At this time, a dummy gate signal having the H level (DM1) is supplied to the gate of the transistor 40*f* in the capacitive line control circuit 40*b* of the first stage via the dummy gate line 20*e* (see FIG. 11). Accordingly, the signal having the L level is supplied to the latch circuit 40*d* via the source and the drain of the transistor 40*f* and is stored in the latch circuit 40*d* such that the node 3 (ND3) side becomes the L level state. Similar to the above description, the switch 4*h* becomes the ON state such that the potential of SC1 becomes the L level.

Next, at a time t12, the ON signal is supplied to the gate 20*a* corresponding to the pixels 1*a* of the row of the first stage (Gate1 of FIG. 11) such that, with respect to the pixels 1*a* of the row of the first stage, the writing of a video signal corresponding to a high potential side is performed in a state in which the capacitive line 40*a* is held at a low potential side (a portion A1 of the drawing). At this time, the gate signal output from the gate line 20*a* (Gate1) is supplied to the gate of the transistor 40*f* in the capacitive line control circuit 40*b* of the second stage. Accordingly, in the capacitive line control circuit 40*b* of the second stage, the signal having the L level is supplied to the switches 4*h* and 4*i* via the node 3 (ND3) and the node 2 (ND2). Similar to the above description, only the switch 4*h* becomes the ON state such that the COML signal (L level) is supplied to the capacitive line 40*a* of the second stage. That is, at the time t12, the potential of the capacitive line 40*a* of the second stage (the potential of SC2) is changed to the L level.

At a time t13, the ON signal is output from the CSL line 9. At this time, in the capacitive line control circuit 40*b* of the first stage, the transistor 40*g* becomes the ON state and the signal having the L level is supplied to the latch circuit 40*d* such that the node 3 (ND3) becomes the H level state. The switch 4*i* becomes the ON state by the signal having the H level and the COMH signal (H level) is supplied to the capacitive line 40*a* of the first stage via the switch 4*i*. That is, at the time t13, the potential of the capacitive line 40*a* of the first stage (the potential of SC1) is changed to the high potential side, on the basis of the CSL signal. Accordingly, the potential of the pixel electrodes 1*c* of the pixels 1*a* of the row of the first stage to which the video signal is written is changed to the high potential side (a portion A2 of the drawing).

At this time, the CSL signal is supplied to the gate of the transistor 40*g* in the capacitive line control circuit 40*b* of the second stage. Accordingly, by the same operation as the above operation, the potential of the capacitive line 40*a* of the second stage (the potential of SC2) becomes the H level only in the same period as the period in which the CSL signal is in the ON state. At the time t13, the ON signal is output from the gate line 20*a* corresponding to the pixels 1*a* of the row of the second stage (Gate2 of the drawing). Accordingly, with respect to the row of the second stage, the writing of the video signal corresponding to the low potential side is performed to the pixels 1*a* in a state in which the potential of the capacitive line 40*a* is held at the high potential side (a portion B of the drawing).

At a time t14, the ON signal is output from the gate line 20*a* corresponding to the pixels 1*a* of the third stage (Gate3 of the drawing) such that, with respect to of the row of the third stage, the writing of the video signal corresponding to the high potential side to the pixels 1*a* is performed in a state in which the potential of the capacitive line 40*a* is held at the low potential side, similar to the above description. Accordingly, by the above configuration, the video signal corresponding to the high potential side and the video signal corresponding to the low potential side are sequentially alternately written to each row.

In one next vertical period (1V period), at a time t17, the dummy gate signal having the H level (DM1 of the drawing) is supplied from the dummy gate line 20*e* to the transistor 40*f* in the capacitive line control circuit 40*b* of the first stage. Accordingly, the switch 4*i* becomes the ON state and the COMH signal is supplied to the capacitive line 40*a* of the first stage (SC1). The potential of the capacitive line 40*a* of the first stage (the potential of SC1) is changed to the low potential side. At a time t18, the CSL signal having the H level is supplied to the gate of the transistor 40*g* in each of the capacitive line control circuits 40*b*, and the dummy gate signal having the H level (DM0 of the drawing) is supplied from the dummy gate line 20*d* to the gate of the transistor 40*e* in the capacitive line control signal 40*b* of the first stage. Accordingly, the capacitive line 40*a* of each of the stages is changed to the high potential side by supplying the COMH signal, on the basis of the CSL signal, and is immediately returned to the low potential side on the basis of the dummy age signal (DM0) in the capacitive line 40*a* of the first stage.

In this state, at a time t19, the gate signal having the H level is output from the gate line 20*a* corresponding to the pixels 1*a* of the second stage (Gate2) such that, with respect to the pixels 1*a* of the row of the second stage, the video signal corresponding to the high potential side is written in a state in which the potential of the capacitive line 40*a* is held at the low potential side. At a time t20, the CSL signal having the H level is supplied to each of the capacitive line control circuits 40*b* such that the potential of the capacitive line 40*a* of the first stage is changed to the high potential side. Accordingly, the potential of the pixel electrodes 1*c* of the pixels 1*a* of the row of the second stage, to which the video signal is written, is further changed to the high potential side. At this time, the gate lien 20*a* corresponding to the pixels 1*a* of the row of the first stage (Gate1) becomes the ON state such that, with respect to the pixels 1*a* of the row of the first stage, the video signal corresponding to the low potential side is written in a state in which the potential of the capacitive line 40*a* (the potential of SC1) is held at the high potential side. That is, the video signal is written to the pixels 1*a* of the second stage and the video signal is then drawn in the pixels 1*a* of the first stage. Even in the pixels 1*a* of the third stage or the subsequent stages thereof, first, the video signal of the pixels 1*a* of the fourth stage is written and the video signal is then written to the pixels 1*a* of the third stage.

In the second embodiment, a first writing mode for performing the writing in order of Gate1, Gate 2, Gate3, Gate4, . . . from the pixels 1*a* of the row of an upper stage, which becomes a previous stage, to the pixels 1*a* of the row of a lower stage, which becomes a next stage, for each vertical period and a second writing mode for performing the writing of the video image in order of Gate2, Gate1, Gate4, Gate3, . . . from the pixels 1*a* of the row of the lower stage, which becomes the next stage, to the pixels 1*a* of the row of the upper stage, which becomes the previous stage, for every rows of two stages are alternately performed. In addition, in the so-called reverse scanning in which the writing to the pixels is performed from the row of the lower stage to the row of the upper stage, reading is performed in a state in which the lower stage corresponds to the previous stage and the upper stage corresponds to the next stage.

The other operation of the second embodiment is equal to that of the first embodiment.

In the second embodiment, as described above, since one capacitive line 40*a* corresponds to the pixels 1*a* of two rows by providing the capacitive line 40*a* and the capacitive line control circuit 40*b* one by one in the pixels 1*a* of two rows, it is possible to suppress the increase in the number of capacitive lines 40*a*. Therefore, it is possible to increase the transmissivity of the light source in each of the pixels 1*a* by decreasing the number of capacitive lines 40*a*. That is, it is possible to increase the aperture ratio of the pixels 1*a*. In addition, it is possible to simplify the circuit configuration by decreasing the number of capacitive line control circuits 40*b*.

In the second embodiment, since the v driver 20 is arranged at the positions sandwiching the display screen unit 1 one by one, that is, the two V drivers 20 are provided with the display screen unit 1 interposed therebetween, the distance of the gate line 20*a* from the v driver 20 to the pixels 1*a* can be decreased compared with the case where one V driver 20 is arranged. Accordingly, it is possible to suppress the increase in wire resistance and wire capacity. As a result, since a time constant can be reduced, it is possible to write the video signal to the pixels 1*a* with accuracy.

The other effect of the second embodiment is equal to that of the first embodiment.

Third Embodiment

Figure 13:
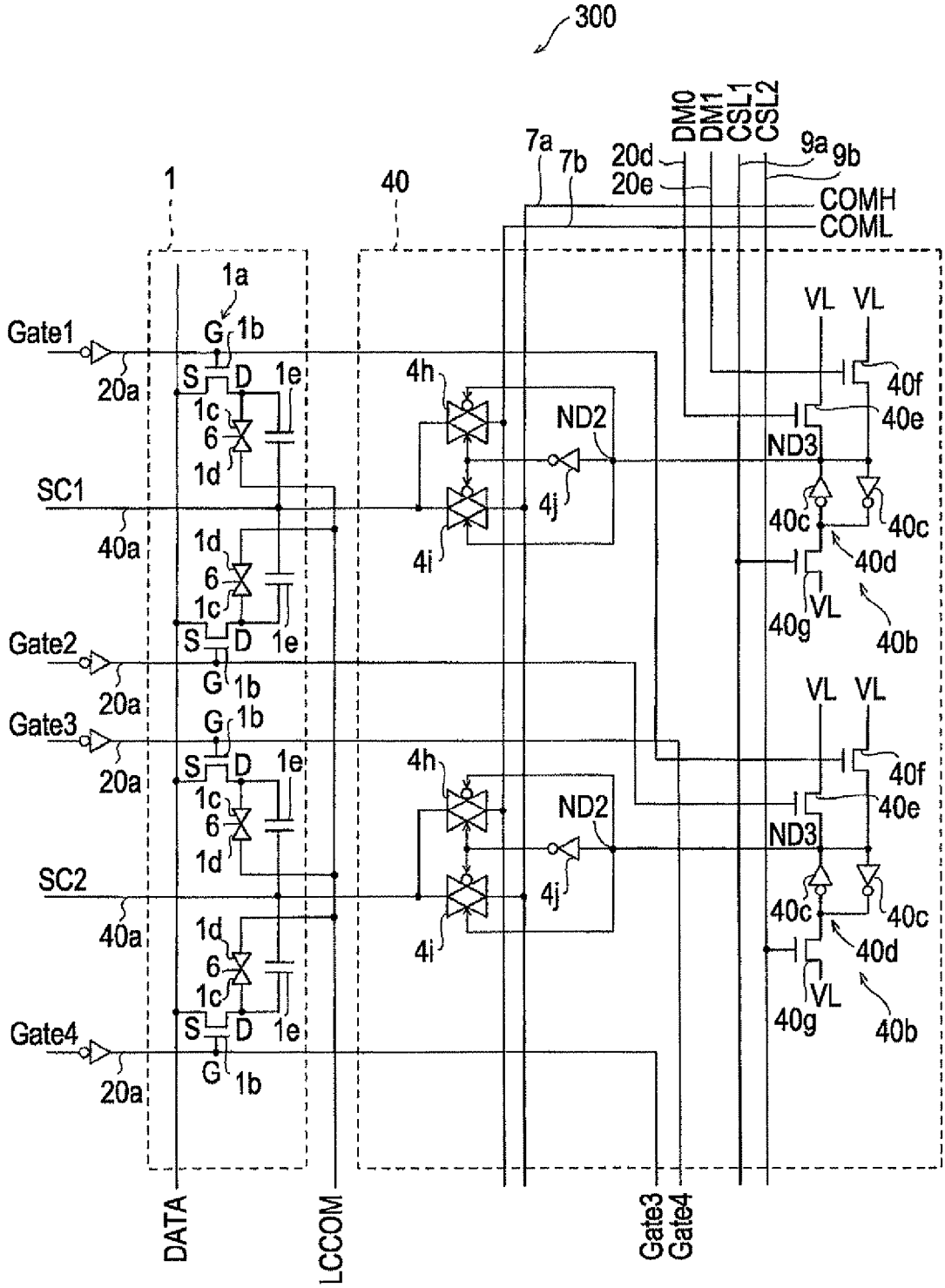
FIG. 13 is a circuit diagram showing the configuration of a liquid crystal display device according to a third embodiment of the invention.
Figure 14:
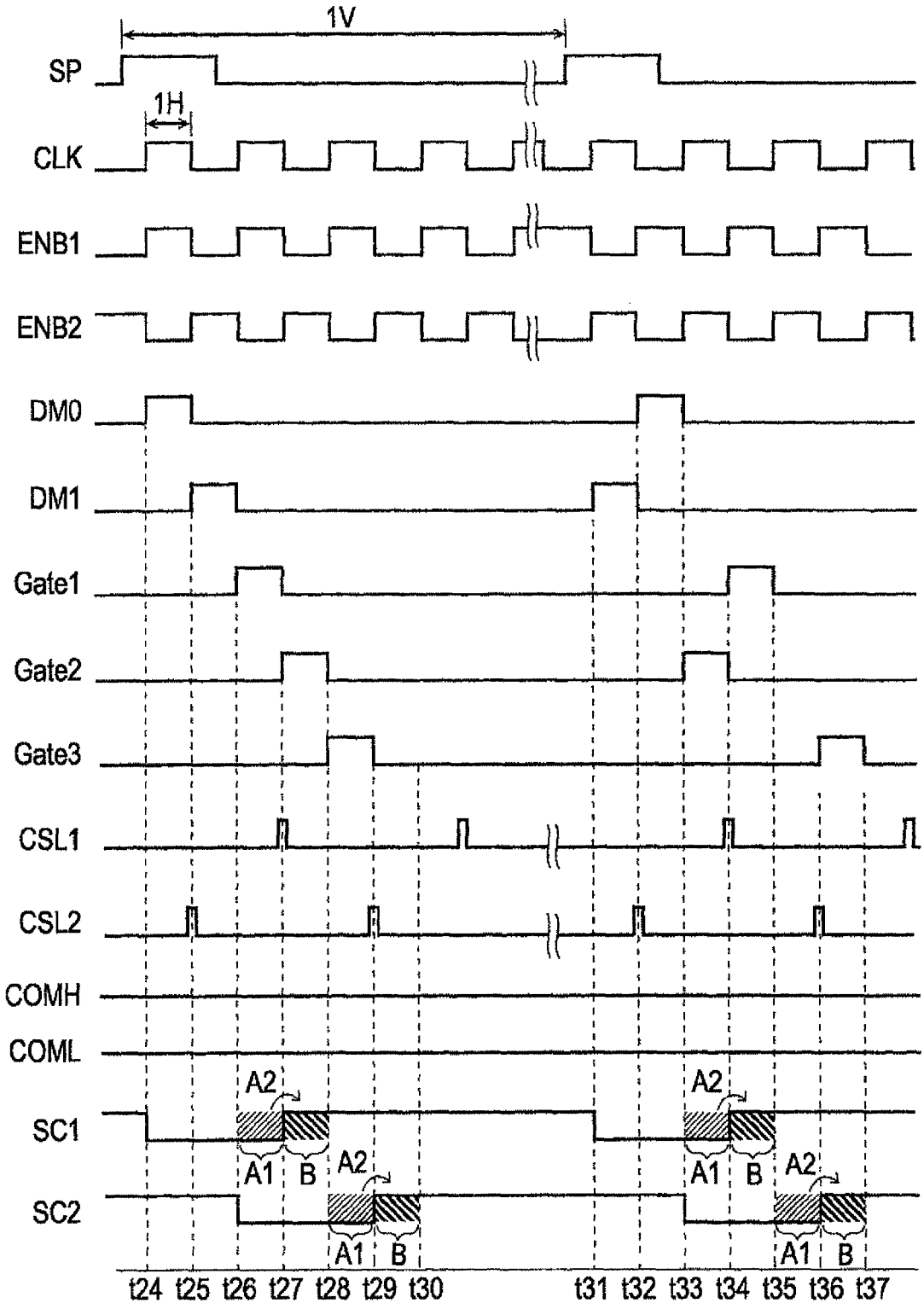
FIG. 14 is a timing chart explaining an operation when a video signal is written, in the liquid crystal display device according to the third embodiment of the invention.

FIGS. 13 and 14 are views explaining the configuration of a liquid crystal display device according to a third embodiment of the invention. In the third embodiment, an example of driving capacitive Line control circuits 40*b* by two CSL signals (CSL1 and CSL2) will be described with reference to FIGS. 13 and 14, unlike the second embodiment in which the capacitive line control circuits 40*b* are driven by one CSL signal.

In the liquid crystal display device 300 according to the third embodiment of the invention, as shown in FIG. 13, a CSL1 signal is supplied to the capacitive line control circuit 40*b* of the odd-numbered stage and a CSL2 signal is supplied to the capacitive line control circuit 40*b* of the even-numbered stage. In detail, a CSL1 line 9*a* for supplying the CSL1 signal is connected to the gate of the transistor 40*g* in the capacitive line control circuit 40*b* of the odd-numbered stage and a CSL2 signal 9*b* for supplying the CSL2 signal is connected to the gate of the transistor 40*g* in the capacitive line control circuit 40*b* of the even-numbered stage.

The other configuration of the third embodiment is equal to that of the second embodiment.

Next, the operation when the video signal is written in the liquid crystal display device 300 according to the third embodiment of the invention will be described with reference to FIGS. 13 and 14.

First, the same operation as the operation of the time t10 (see FIG. 12) of the second embodiment is performed. That is, the dummy gate signal (DM0) having the H level is output from the dummy gate line 20*d* such that the potential of the capacitive line 40*a* of the first stage (the potential of SC1) is changed to the low potential side. At a time t25, the dummy gate signal (DM1) having the H level is output from the dummy gate line 20*e* and the signal having the H level is output from the CSL2 line 9*b*. The dummy gate signal (DM1) is supplied to the gate of the transistor 40*f* in the capacitive line control circuit 40*b* of the first stage such that the potential of the capacitive line 40*a* of the first stage (the potential of SC1) is continuously held at the low potential side. That is, in the second embodiment, the potential of the capacitive line 40*a* is changed to the low potential side, is then changed to the high potential state once by the CSL signal after the 1 H period, and is returned to the low potential side. In contrast, in the third embodiment, the potential of the capacitive line 40*a* changed to the low potential side is controlled to be continuously held at the low potential side in a period (2 H period) until the video signal is written.

The signal having the H level output from the CSL2 line 9*b* is supplied to the gate of the transistor 40*g* in the capacitive line control circuit 40*b* of the second stage. Accordingly, the potential of the capacitive line 40*a* of the second stage is continuously held at the high potential side. At a time t26, with respect to the pixels 1*a* of the first stage, the video signal corresponding to the high potential side is written in a state in which the potential of the capacitive line 40*a* is held at the low potential side.

At a time t27, the potential of the capacitive line 40*a* in the pixels 1*a* of the first stage, to which the video signal is written, is changed from the low potential side to the high potential side and thus the potential of the pixel electrode 1*c* of the pixels 1*a* corresponding thereto is also changed to the high potential side (a portion A1 of the drawing). At this time, the video signal corresponding to the low potential side is written to the pixels 1*a* of the second stage in a state in which the potential of the capacitive line 40*a* is held at the high potential side. The video signal is written by the same operation from the row of the upper end corresponding to the previous stage to the row of the lower end corresponding to the next stage.

Even in one next vertical period (1V period), similarly, at the time of writing the video signal, the potential of the capacitive line 40*a* changed to the low potential side once is controlled to be continuously held at the low potential side until the video signal is written. In the sequence of the writing of the video signal, similar to the second embodiment, the writing to the pixels 1*a* of the row of the first stage is performed after the writing to the pixels 1*a* of the row of the second stage. That is, the writing of the video signal from the pixels 1*a* of the lower stage to the pixels 1*a* of the upper stage for every rows of two stages is performed like Gate2, Gate1, Gate4, Gate3, . . . .

In the third embodiment, as described above, unlike the second embodiment, since the potential of the capacitive line 40*a* changed to the low potential side is controlled to be continuously held at the low potential side until the video signal is written by providing the two CSL signals (CSL1 and CSL2) in order to drive the capacitive line control circuit 40*b*, it is possible to suppress the unnecessary change of the potential of the capacitive line 40*a* at the time of writing the video signal. Accordingly, it is possible to write the video signal with accuracy.

The other effect of the third embodiment is equal to that of the second embodiment.

The disclosed embodiments have only been given by way of example for explanation of the invention and the range of the invention is not to be considered as being limited by the details of those embodiments. The range of the invention is expressed by claims instead of the description of the above embodiment, and all modifications are included in the claims and equivalent thereof.

For example, although, in the first to third embodiments, the example of arranging the capacitive line control circuit in one side of the display screen unit is described, the invention is not limited to this, and the capacitive line control circuits may be arranged at both sides of the display screen unit. Accordingly, it is possible to reduce the time constant by decreasing the distance (signal transmission path) from the capacitive line driving circuit of the capacitive line.

Although, in the first to third embodiments, the example in which the OFF potential of the gate signal is the reference potential, that is, the ground level (GND), of the liquid crystal display device is described, the invention is not limited to this. The OFF potential of the gate signal may be set to the ground potential or the low potential of the driving power source of the V driver 2.

Although, in the first to third embodiments, the example of applying the method of sequentially writing the video signal in one direction (single direction) with respect to the pixels to the invention is described, the invention is not limited to this. A method of writing the video signal in bi-direction with respect to the pixels is applicable to the invention.

The peripheral circuits such as driver circuit, the driving circuit, the driving IC and so on described in the first to third embodiment may be formed on the same glass substrate as the pixel electrodes on the substrate of the liquid crystal display device using a system-on-glass (SOG) technique. Accordingly, it is possible to reduce the number of semiconductor components, simplify assembling, decrease the size of the external circuit board, and realize reduction of weight, size and cost.

Although an example of applying the liquid crystal display device of the first embodiment of the invention to an electronic apparatus is described, the invention is not limited to this. The liquid crystal display devices of the second and third embodiments of the invention are applicable to the electronic apparatus according to the first embodiment.

The entire disclosure of Japanese Patent Application No. 2008-119953, filed May 1, 2008 are expressly incorporated by reference herein.

What is claimed is:

1. An electro-optical device comprising:

pixel electrodes provided in intersections of gate lines and data lines;

counter electrodes provided to face the pixel electrodes with an electro-optical material interposed therebetween; and storage capacitors each of which one end is connected to each of the pixel electrodes, wherein, if data line signals supplied to the pixel electrodes via the data lines correspond to writing of a positive polarity with respect to the potential of the counter electrodes, the potential of the other end of each of the storage capacitors is changed to a high potential side after the data line signals are written and, if the data line signals correspond to writing of a negative polarity with respect to the potential of the counter electrodes, the potential of the other end of each of the storage capacitors is held at a constant level before and after the data line signals are written.

2. The electro-optical device according to claim 1, further comprising:

pixel transistors connected to the pixel electrodes;

gate lines which supply gate signals for controlling ON/OFF of the pixel transistors;

a gate line scanning unit which scans the gate lines; and a driving power source which supplies a driving power source potential to the gate line scanning unit, wherein an OFF potential of the gate signals supplied to the pixel transistors becomes a reference potential of the electro-optical device.

3. The electro-optical device according to claim 2, further comprising:

capacitive lines connected to the storage capacitors; and capacitive line control circuits which control the potentials of the storage capacitors via the capacitive lines, wherein the capacitive line control circuits are connected to the gate lines, and control the potentials of the storage capacitors on the basis of the gate signals supplied from the gate lines.

4. The electro-optical device according to claim 3, wherein:

the capacitive line control circuits are provided in the capacitive lines, respectively, a plurality of pixels having the pixel transistors, and a dummy gate line connected to the capacitive line control circuit arranged in correspondence with the capacitive line of a first stage are further included, and a signal for controlling the potential of the storage capacitor corresponding to the capacitive line of the first stage is supplied from the capacitive line control circuit arranged in correspondence with the capacitive line of the first stage to the capacitive line of the first stage, on the basis of a dummy gate signal supplied by the dummy gate line.

5. The electro-optical device according to claim 4, wherein:

the plurality of pixels are arranged in a matrix, and the data line signals supplied to the pixel electrodes are switched to the data line signals corresponding to the writing of the positive polarity with respect to the potential of the counter electrodes and the data line signals corresponding to the writing of the negative polarity with respect to the potential of the counter electrodes, for each horizontal line of the plurality of pixels arranged in the matrix.

6. The electro-optical device according to claim 4, wherein the capacitive line and the capacitive line control circuit are provided one by one in the pixels of one row.

7. The electro-optical device according to claim 4, wherein the capacitive line and the capacitive line control circuit are provided one by one in the pixels of a plurality of rows.

8. The electro-optical device according to claim 7, wherein a first writing mode for sequentially performing writing from the pixels of a previous stage to the pixels of a next stage one stage by one stage for each vertical period and a second writing mode for sequentially performing writing in order opposite to the first writing mode from the pixels of the previous stage to the pixels of the next stage for every two stages are alternately performed at the time of writing the data line signals.

9. The electro-optical device according to claim 4, further comprising:

a display unit including the plurality of pixels, wherein the gate line scanning units are arranged at positions sandwiching the display unit one by one.

10. An electronic apparatus comprising the electro-optical device according to claim 1.

* * * * *